US008210823B2

(12) United States Patent
Ward et al.

(10) Patent No.: US 8,210,823 B2
(45) Date of Patent: Jul. 3, 2012

(54) METHOD AND APPARATUS FOR CREATING SEAL SLOTS FOR TURBINE COMPONENTS

(75) Inventors: John D. Ward, Woodruff, SC (US); Srikanth Kottilingam, Simpsonville, SC (US); Daniel Tragesser, Simpsonville, SC (US); Steven Rauch, Yorktown, VA (US)

(73) Assignee: General Electric Company, Schenectady, NY (US)

( * ) Notice: Subject to any disclaimer, the term of this patent is extended or adjusted under 35 U.S.C. 154(b) by 1006 days.

(21) Appl. No.: 12/168,935

(22) Filed: Jul. 8, 2008

(65) Prior Publication Data

US 2010/0008781 A1 Jan. 14, 2010

(51) Int. Cl.
*F01D 5/30* (2006.01)

(52) U.S. Cl. ..... 416/220 R

(58) Field of Classification Search ..... 416/220 R, 416/219 R, 248 N, 220 A, 204 A
See application file for complete search history.

(56) References Cited

U.S. PATENT DOCUMENTS

| | | | | |
|---|---|---|---|---|
| 3,709,631 | A | 1/1973 | Karstensen et al. | |
| 3,986,779 | A * | 10/1976 | Beckershoff | 403/20 |
| 4,422,827 | A | 12/1983 | Buxe et al. | |
| 4,477,226 | A * | 10/1984 | Carreno | 416/144 |
| 4,480,957 | A | 11/1984 | Patel et al. | |
| 4,494,909 | A | 1/1985 | Forestier | |
| 4,527,952 | A * | 7/1985 | Forestier et al. | 416/220 R |
| 4,725,200 | A | 2/1988 | Welhoelter | |
| 4,743,164 | A | 5/1988 | Kalogeros | |
| 4,743,166 | A | 5/1988 | Elston, III et al. | |
| 4,820,187 | A * | 4/1989 | May | 439/359 |
| 5,052,890 | A | 10/1991 | Roberts | |
| 5,052,893 | A | 10/1991 | Catte | |
| 5,139,389 | A | 8/1992 | Eng et al. | |
| 5,257,909 | A | 11/1993 | Glynn et al. | |
| 5,599,170 | A | 2/1997 | Marchi et al. | |
| 5,823,743 | A | 10/1998 | Faulkner | |
| 5,860,787 | A * | 1/1999 | Richards | 416/220 R |
| 6,273,683 | B1 | 8/2001 | Zagar et al. | |
| 6,296,172 | B1 | 10/2001 | Miller | |
| 6,375,429 | B1 | 4/2002 | Halila et al. | |
| 6,422,820 | B1 * | 7/2002 | Anderson et al. | 416/217 |
| 6,565,322 | B1 | 5/2003 | Lieser et al. | |
| 6,575,704 | B1 | 6/2003 | Tiemann | |
| 6,682,307 | B1 | 1/2004 | Tiemann | |
| 7,661,931 | B1 * | 2/2010 | Matheny | 416/220 R |

FOREIGN PATENT DOCUMENTS

| | | |
|---|---|---|
| EP | 0774048 A1 | 5/1997 |
| WO | 9412772 A1 | 6/1994 |

* cited by examiner

*Primary Examiner* — Douglas King
(74) *Attorney, Agent, or Firm* — Sutherland Asbill & Brennan LLP

(57) ABSTRACT

A sealing slot system for a turbine dovetail. The sealing slot system may include a dovetail tab with a first leg and a second leg, an insert positioned between the first leg and the second leg so as to define a sealing slot, and a pin extending through the dovetail tab and the slot insert.

15 Claims, 3 Drawing Sheets

METHOD AND APPARATUS FOR CREATING SEAL SLOTS FOR TURBINE COMPONENTS

TECHNICAL FIELD

The present application relates generally to any type of turbine and more particularly relates to systems and methods for creating sealing slots within a bucket dovetail tab.

BACKGROUND OF THE INVENTION

Gas turbines generally include a turbine rotor (wheel) with a number of circumferentially spaced buckets (blades). The buckets generally may include an airfoil, a platform, a shank, a dovetail, and other elements. The dovetail of each bucket is positioned within the turbine rotor and secured therein. The airfoils project into the hot gas path so as to convert the kinetic energy of the gas into rotational mechanical energy. A number of cooling medium passages may extend radially through the bucket to direct an inward and/or an outward flow of the cooling medium therethrough.

Leaks may develop in the coolant supply circuit based upon a gap between the tabs of the dovetails and the surface of the rotor due to increases in thermal and or centrifugal loads. Air losses from the bucket supply circuit into the wheel space may be significant with respect to blade cooling medium flow requirements. Moreover, the air may be extracted from later compressor stages such that the penalty on energy output and overall efficiency may be significant during engine operation.

Efforts have been made to limit this leak. For example, one method involves depositing aluminum on a dovetail tab so as to fill the gap at least partially. Specifically, a circular ring may be pressed against the forward side of the dovetail face. Although this design seals well and is durable, the design cannot be easily disassembled and replaced in the field. Rather, these rings may only be disassembled when the entire rotor is disassembled.

Other known methods include those described in commonly owned Ser. No. 12/168,297, filed herewith, entitled "Gas Turbine Seal"; Ser. No. 12/168,932, also filed herewith, entitled "Labyrinth Seal for Turbine Dovetail"; and similar types of dovetail seals and methods. These seals and methods generally may use a sealing slot positioned about a tab of a dovetail. These slots, however, can be difficult to manufacture and may require non-conventional machining processes. Current methods may include EDM (Electrical Discharge Machining), keyway cutting, end milling, or hybrid processes.

There is thus a desire for improved dovetail tab sealing systems and methods. Such systems and methods should provide a substantially uniform sealing slot without the use of the non-conventional machining processes. Such a substantially uniform sealing slot may be used with a number of different seals and methods so as to adequately prevent leakage therethrough and to increase overall system efficiency.

SUMMARY OF THE INVENTION

The present application thus provides a sealing slot system. The sealing slot system may include a dovetail tab with a first leg and a second leg, an insert positioned between the first leg and the second leg so as to define a sealing slot, and a pin extending through the dovetail tab and the slot insert.

The present application further provides a sealing slot system. The sealing slot system may include a dovetail tab with a first leg and a second leg and an insert positioned between the first leg and the second leg so as to define a sealing slot.

The insert may include a locating hole therethrough. A pin extends through the first leg of the dovetail tab and the locating hole of the insert.

The present application further provides a method of forming a sealing slot in a dovetail tab of a bucket. The method may include the steps of machining a through-slot in the dovetail tab, inserting an insert within the through-slot so as to define the sealing slot, and securing the insert within the dovetail tab.

These and other features of the present application will become apparent to one of ordinary skill in the art upon review of the following detailed description when taken into conjunction with the several drawings and the appended claims.

DETAILED DESCRIPTION

Figure 1A:
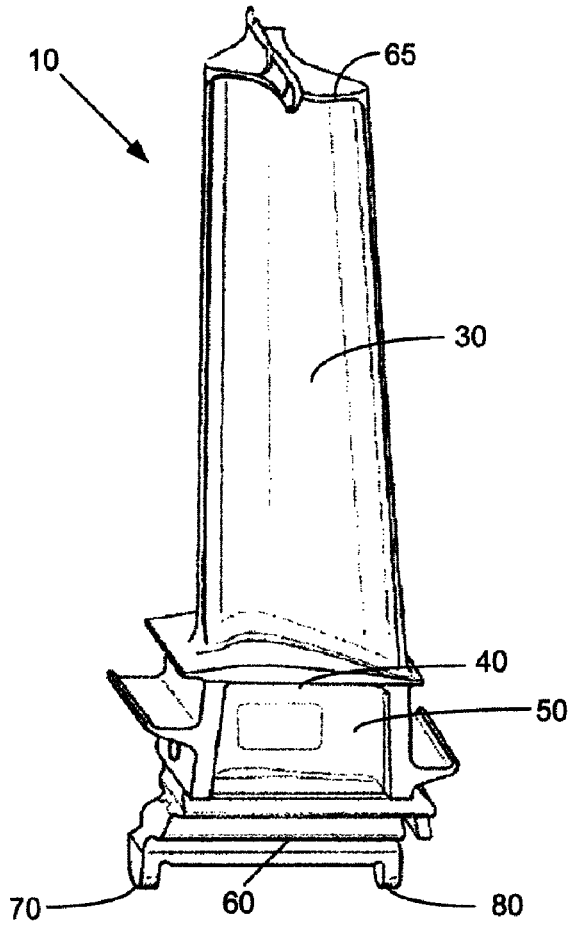
FIG. 1A is a perspective view of a bucket with a shroud that may be used with the sealing systems as are described herein.
Figure 2:
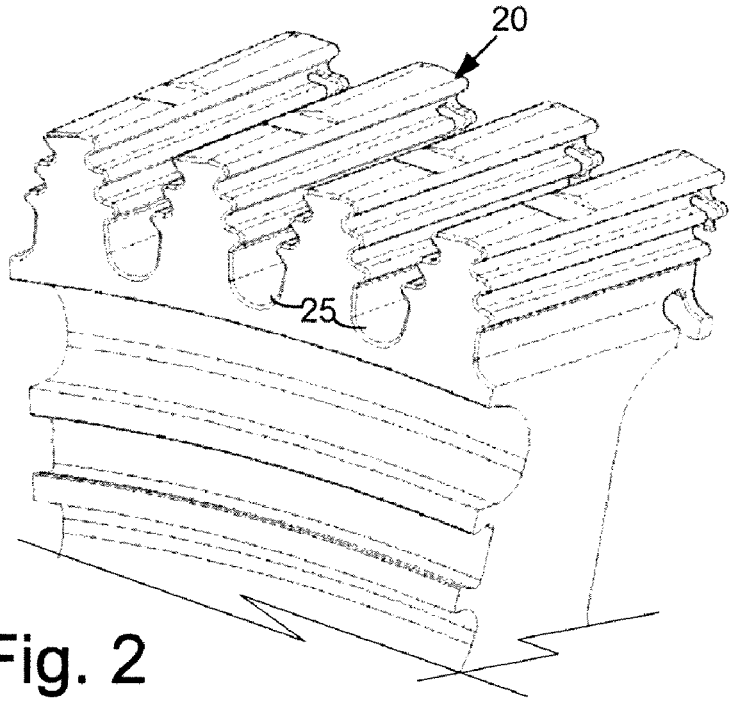
FIG. 2 is a perspective view of a rotor.

Referring now to the drawings, in which like numerals refer to like elements throughout the several views, FIG. 1A shows a bucket 10 as may be used herein. The bucket 10 may be a first or a second stage bucket as used in a 7FA+e gas turbine sold by General Electric Company of Schenectady, N.Y. Any other type of bucket or stage also may be used herein. The bucket 10 may be used with a rotor 20 as is shown in FIG. 2.

Figure 1B:
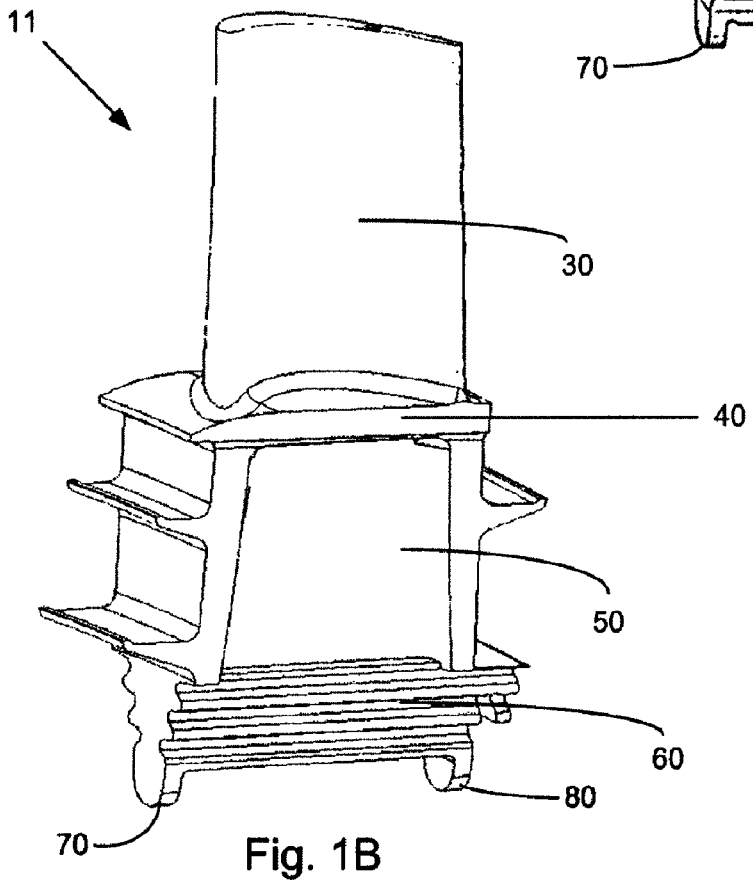
FIG. 1B is a perspective view of a bucket without a shroud that may be used with the sealing systems as are described herein.

As is known, the bucket 10 may include an airfoil 30, a platform 40, a shank 50, a dovetail 60, and other elements. It will be appreciated that the bucket 10 is one of a number of circumferentially spaced buckets 10 secured to and about the rotor 20 of the turbine. The bucket 10 of FIG. 1A has a shroud 65 on one end of the airfoil 30. A bucket 11 of FIG. 1B lacks the shroud. Any other type of bucket design may be used herein.

As described above, the rotor 20 may have a number of slots 25 for receiving the dovetails 60 of the buckets 10, 11. Likewise, the airfoils 30 of the buckets 10, 11 project into the hot gas stream so as to enable the kinetic energy of the stream to be converted into mechanical energy through the rotation of the rotor 20. The dovetail 60 may include a first tang or tab 70 and a second tab 80 extending therefrom. Similar designs may be used herein. A gap 90 may be formed between the ends of the tabs 70, 80 of the dovetail 60 and the rotor 20. A high pressure cooling flow may escape via the gap 90 unless a sealing system of some type is employed.

Figure 3:
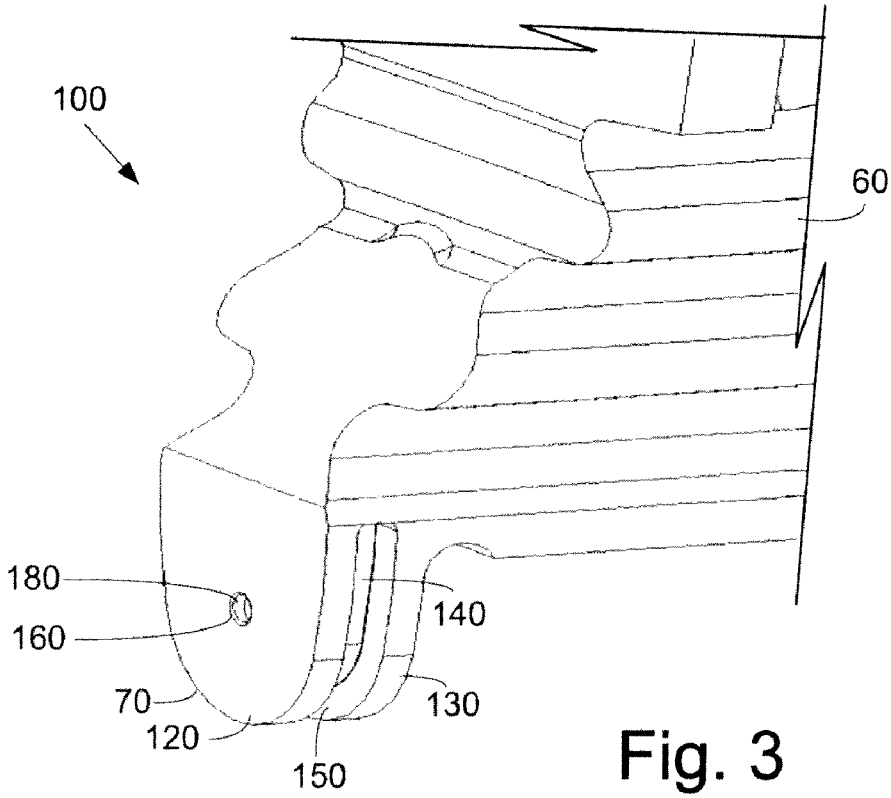
FIG. 3 is a perspective view of a sealing slot system as is described herein and installed within a dovetail tab.
Figure 4:
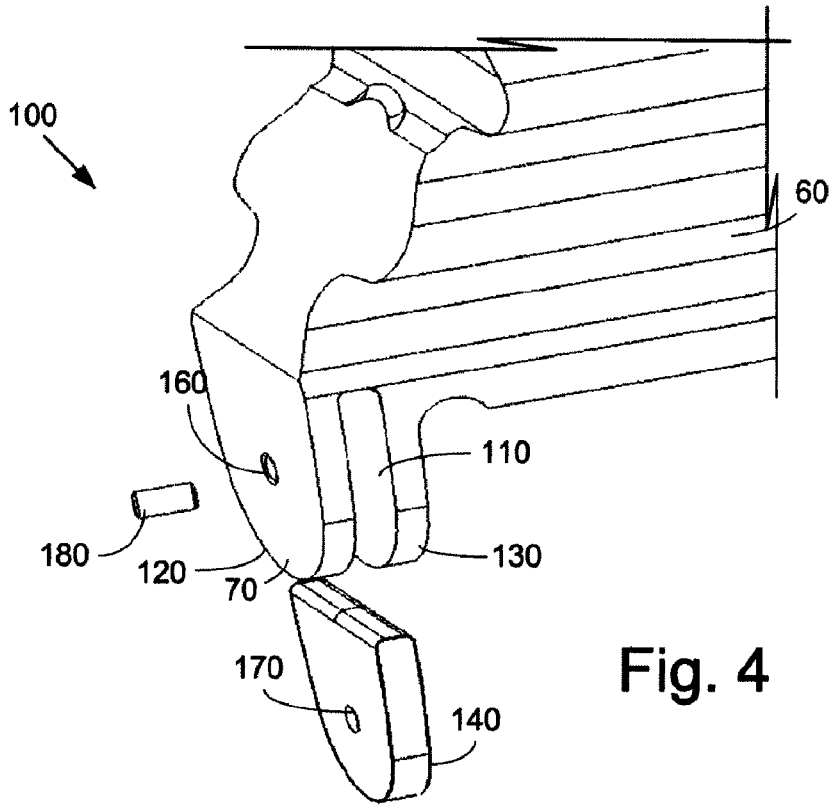
FIG. 4 is an exploded view of the sealing slot system of FIG. 3.
Figure 5:
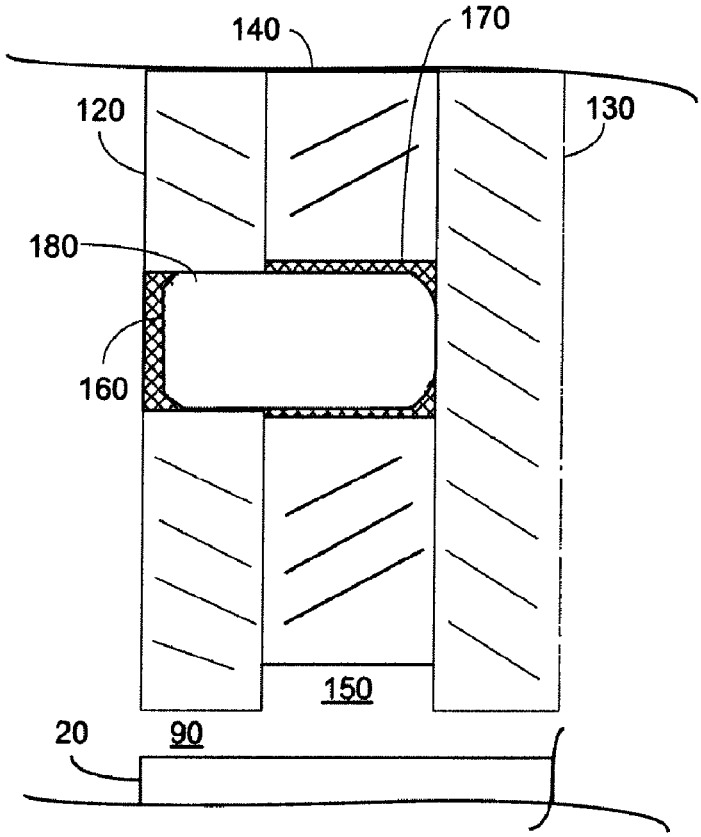
FIG. 5 is a side cross-sectional view of the sealing slot system of FIG. 3.

FIGS. 3-5 show a sealing slot system 100 as is described herein. The sealing slot system 100 includes a through-slot 110 positioned within the first tab 70 and the second tab 80 of the dovetail 60. The through-slot 110 may be formed by conventional machining techniques or similar types of methods. The through-slot 110 may extend across the length and the width of the tabs 70, 80 in whole or in part. The through-slot 110 defines a first leg 120 and a second leg 130 on each tab, 70, 80.

A seal slot insert 140 may be positioned within the through-slot 110. The seal slot insert 140 also may be created by conventional machining techniques or similar types of methods. When positioned in the through-slot 110, the seal slot insert 140 is sized so as to form a seal slot 150 about the perimeter of each tab 70, 80 between the legs 120, 130. The size and shape of the seal slot 150 may vary.

The first leg 120 (i.e., the outer leg) of the tabs 70, 80 may include a pinhole 160 extending therethrough. The second leg 130 (i.e., the inner leg) of the tabs 70, 80 need not have the pinhole 160 formed therein. Likewise, the seal slot insert 140 includes a locating hole 170. The seal slot insert 140 is held in place via a pin 180 that extends through the pinhole 160 of the tab 70, 80 and the locating hole 170 of the seal slot insert 140. The pin 180 may then be welded or brazed into place or affixed by other type of conventional means. A press fit, a threaded joint, and other mechanical joining means also may be used. The pin 180 may be permanently or temporarily affixed. The pin 180 may be installed in the factory or in the field.

The locating hole 170 may have an equal or slightly greater diameter than that of the pin 180. This larger diameter allows the seal slot insert 140 to float to some extent when the bucket 10, 11 is in operation. This float effectively ensures an equal depth for the seal slot 150 on both sides of the tabs 70, 80, i.e., about the three and the nine o'clock positions. (These regions are the most difficult to control when non-conventional machining techniques are used.) For example, if the pin 180 has a diameter of about 0.098 inches (about 2.49 millimeters), the pinhole 160 may have a diameter of about 0.1 inch (about 2.54 millimeters) so as to allow the pin 180 to pass therethrough while the locating hole 170 may have a diameter of about 0.105 inches (about 2.67 millimeters) so as to provide a certain amount of float. These dimensions are by way of example only. Other dimensions may be used herein.

The sealing slot system 100 thus provides the sealing slot 150 without the use of non-conventional machining methods. Rather, the sealing slot insert 140 and the holes 160, 170 may be manufactured with conventional, rather low cost techniques while reducing the chances of non-conforming parts. The sealing slot system 100 then may be used with various types of dovetail seals, including those described above.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A sealing slot system, comprising:
a dovetail tab;
the dovetail tab comprising a first leg and a second leg;
the first leg and the second leg are spaced apart to form a through-slot therebetween;
an insert is disposed within the through slot between the first leg and the second leg so as to define a sealing slot about a perimeter of the insert;
a pin extending through the dovetail tab and the insert; and
a gap between the dovetail and a rotor,
wherein fluid leaking through the gap about the dovetail tab and the rotor is regulated by the sealing slot.

2. The sealing slot system of claim 1, wherein the insert comprises a locating hole and the pin extends therein.

3. The sealing slot system of claim 2, wherein the pin comprises a first diameter, the locating hole comprises a second diameter, and wherein the second diameter is equal to or larger than the first diameter.

4. The sealing slot system of claim 3, wherein the first leg comprises a pinhole and wherein the pin extends therein.

5. The sealing slot system of claim 4, wherein the pinhole comprises a third diameter.

6. The sealing slot system of claim 1, wherein the pin comprises a weld.

7. A sealing slot system, comprising:
a dovetail tab;
the dovetail tab comprising a first leg and a second leg;
the first leg and the second leg are spaced apart to form a through-slot therebetween;
an insert is disposed within the through-slot between the first leg and the second leg so as to define a sealing slot about a perimeter of the insert;
the insert comprising a locating hole therethrough;
a pin extending through the first leg of the dovetail tab and the locating hole of the insert; and
a gap between the dovetail and a rotor,
wherein fluid leaking through the gap about the dovetail tab and the rotor is regulated by the sealing slot.

8. The sealing slot system of claim 7, wherein the pin comprises a first diameter, the locating hole comprises a second diameter, and wherein the second diameter is equal to or larger than the first diameter.

9. The sealing slot system of claim 8, wherein the first leg comprises a pinhole and wherein the pin extends therein.

10. The sealing slot system of claim 9, wherein the pinhole comprises a third diameter.

11. The sealing slot system of claim 7, wherein the pin comprises a weld.

12. A method of forming a sealing slot in a dovetail tab of a bucket for regulating a leak from a gap between the dovetail tab and a rotor, comprising:
machining a through-slot in the dovetail tab;
inserting an insert within the through-slot so as to define the sealing slot along a perimeter of the insert;
machining a locating hole in the insert;
securing the insert within the dovetail tab by inserting a pin through the dovetail tab and the insert; and
regulating fluid leaking through the gap with the sealing slot.

13. The method of claim 12, further comprising machining a pinhole in the dovetail tab.

14. The method of claim 12, wherein the pin comprises a first diameter, the locating hole comprises a second diameter, the second diameter is larger than the first diameter, and wherein the method further comprises floating the insert when the bucket operates.

15. The method of claim 12, further comprising welding, brazing, or attaching the pin to the dovetail tab.

* * * * *